US011236690B2

(12) United States Patent
Cao et al.

(10) Patent No.: US 11,236,690 B2
(45) Date of Patent: Feb. 1, 2022

(54) ENGINE CYLINDER OUTPUT LEVEL MODULATION

(71) Applicant: Tula Technology, Inc., San Jose, CA (US)

(72) Inventors: Yongyan Cao, San Jose, CA (US); Elliott A. Ortiz-Soto, San Jose, CA (US); Louis J. Serrano, Los Gatos, CA (US)

(73) Assignee: Tula Technology, Inc., San Jose, CA (US)

( * ) Notice: Subject to any disclaimer, the term of this patent is extended or adjusted under 35 U.S.C. 154(b) by 0 days.

(21) Appl. No.: 17/332,763

(22) Filed: May 27, 2021

(65) Prior Publication Data

US 2021/0404397 A1 Dec. 30, 2021

Related U.S. Application Data

(60) Provisional application No. 63/043,253, filed on Jun. 24, 2020.

(51) Int. Cl.

| | |
|---|---|
| ***F02D 17/02*** | (2006.01) |
| ***F02D 41/00*** | (2006.01) |
| ***F02D 41/24*** | (2006.01) |

(52) U.S. Cl.

CPC ..... *F02D 41/0087* (2013.01); *F02D 17/02* (2013.01); *F02D 41/2422* (2013.01); *F02D 2250/21* (2013.01)

(58) Field of Classification Search

CPC .. F02D 17/02; F02D 41/0087; F02D 41/2422; F02D 2250/21

USPC ..... 701/101

See application file for complete search history.

(56) References Cited

U.S. PATENT DOCUMENTS

| | | | |
|---|---|---|---|
| 7,577,511 | B1 | 8/2009 | Tripathi et al. |
| 7,849,835 | B2 | 12/2010 | Tripathi et al. |
| 7,886,715 | B2 | 2/2011 | Tripathi et al. |
| 7,954,474 | B2 | 6/2011 | Tripathi et al. |
| 8,099,224 | B2 | 1/2012 | Tripathi et al. |
| 8,131,445 | B2 | 3/2012 | Tripathi et al. |
| 8,131,447 | B2 | 3/2012 | Tripathi et al. |
| 8,616,181 | B2 | 12/2013 | Sahandiefanjani et al. |
| 8,701,628 | B2 | 4/2014 | Tripathi et al. |
| 9,086,020 | B2 | 7/2015 | Tripathi et al. |
| 9,328,672 | B2 | 5/2016 | Serrano et al. |

(Continued)

FOREIGN PATENT DOCUMENTS

| | | |
|---|---|---|
| WO | WO 2010/006311 | 1/2010 |
| WO | WO 2011/085383 | 7/2011 |

*Primary Examiner* — Erick R Solis

(74) *Attorney, Agent, or Firm* — Beyer Law Group LLP

(57) ABSTRACT

A variety of engine controllers and methods are described for controlling engines operating in a cylinder output level modulation mode. In one aspect transitions between different effective firing fractions are managed by gradually ramping an effective firing density. In another, when an engine transitions to a multi-level skip fire firing density that has more than one possible high/low/skip sequence, the phase of the high/low pattern is set relative to the phase of the firing pattern to ensure that a preferred high/low/skip sequence is generated. In another aspect, rapid large torque changes can be implemented in part by immediately changing the operational high/low fraction in response to a command to increase or reduce the desired engine torque.

24 Claims, 4 Drawing Sheets

(56) References Cited

U.S. PATENT DOCUMENTS

| | | | | |
|---|---|---|---|---|
| 9,387,849 | B2 | 7/2016 | Soliman et al. | |
| 9,399,964 | B2 | 7/2016 | Younkins et al. | |
| 9,512,794 | B2 | 12/2016 | Serrano et al. | |
| 9,745,905 | B2 | 8/2017 | Pirjaberi et al. | |
| 2017/0369063 | A1* | 12/2017 | Serrano | B60W 10/06 |
| 2017/0370342 | A1* | 12/2017 | Nagashima | F02D 41/0087 |
| 2018/0043893 | A1* | 2/2018 | Serrano | B60W 10/06 |
| 2018/0112644 | A1* | 4/2018 | Serrano | F02D 41/3058 |

* cited by examiner

FD Sequence Encoding Index Table

200

203

| Sequence ID | FF | HF |
|---|---|---|
| 0 | 0 | 0 |
| 1 | 1/5 | 0 |
| 2 | 1/4 | 0 |
| 3 | 1/3 | 0 |
| 4 | 2/5 | 0 |
| 5 | 1/2 | 0 |
| 6 | 3/5 | 0 |
| 7 | 2/3 | 0 |
| 8 | 3/4 | 0 |
| 9 | 4/5 | 0 |
| 10 | 1 | 0 |
| ⋮ | ⋮ | ⋮ |
| 41 | 1/5 | 2/5 |
| 42 | 1/4 | 2/5 |
| 43 | 1/3 | 2/5 |
| 44 | 2/5 | 2/5 |
| 45 | 1/2 | 2/5 |
| 46 | 3/5 | 2/5 |
| 47 | 2/3 | 2/5 |
| 48 | 3/4 | 2/5 |
| 49 | 4/5 | 2/5 |
| 50 | 1 | 2/5 |
| ⋮ | ⋮ | ⋮ |
| 71 | 1/5 | 2/3 |
| 72 | 1/4 | 2/3 |
| 73 | 1/3 | 2/3 |
| 74 | 2/5 | 2/3 |
| 75 | 1/2 | 2/3 |
| 76 | 3/5 | 2/3 |
| 77 | 2/3 | 2/3 |
| 78 | 3/4 | 2/3 |
| 79 | 4/5 | 2/3 |
| 80 | 1 | 2/3 |
| ⋮ | ⋮ | ⋮ |
| 101 | 1/5 | 1 |
| 102 | 1/4 | 1 |
| 103 | 1/3 | 1 |
| 104 | 2/5 | 1 |
| 105 | 1/2 | 1 |
| 106 | 3/5 | 1 |
| 107 | 2/3 | 1 |
| 108 | 3/4 | 1 |
| 109 | 4/5 | 1 |
| 110 | 1 | 1 |

FIG. 3

220

222

224

230

203(a)

| RPM/ Torque | 1000 | 1250 | 1500 | 1750 | 2000 | 2500 | 3000 |
|---|---|---|---|---|---|---|---|
| 0 | 0 | 0 | 0 | 0 | 0 | 0 | 0 |
| 5 | 2 | 2 | 2 | 2 | 51 | 61 | 71 |
| 10 | 2 | 2 | 2 | 2 | 51 | 61 | 71 |
| 15 | 2 | 2 | 2 | 2 | 51 | 61 | 71 |
| 20 | 2 | 2 | 3 | 4 | 53 | 62 | 82 |
| ... | ... | ... | ... | ... | ... | ... | ... |
| 60 | 10 | 6 | 7 | 35 | 55 | 85 | 95 |
| 65 | 10 | 7 | 7 | 43 | 65 | 85 | 104 |
| 70 | 10 | 10 | 8 | 47 | 67 | 96 | 105 |
| ... | ... | ... | ... | ... | ... | ... | ... |
| 115 | 10 | 10 | 10 | 49 | 77 | 97 | 106 |
| 120 | 110 | 20 | 20 | 69 | 89 | 98 | 107 |
| 125 | 110 | 30 | 40 | 70 | 109 | 109 | 109 |
| ... | ... | ... | ... | ... | ... | ... | ... |
| 160 | 110 | 110 | 110 | 110 | 110 | 110 | 110 |
| 165 | 110 | 110 | 110 | 110 | 110 | 110 | 110 |

FF Sequence Selection Table

*FIG. 4*

ENGINE CYLINDER OUTPUT LEVEL MODULATION

CROSS-REFERENCE TO RELATED APPLICATIONS

This application claims priority of U.S. Provisional Application No. 63/043,253, filed on Jun. 24, 2020 which is incorporated herein by reference in its entirety.

BACKGROUND

The present application relates to methods and systems for operating an engine in a cylinder output level modulation manner. In various embodiments, engine control systems are described that can selectively deactivate working chambers and/or selectively fire working chambers at different output levels.

Most vehicles in operation today (and many other devices) are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver.

The fuel efficiency of many types of internal combustion engines can be improved by varying the displacement of the engine. This allows for the full torque to be available when required, yet can significantly reduce pumping losses and improve thermodynamic efficiency through the use of a smaller displacement when full torque is not required. The most common method of varying the displacement of an engine involves deactivating a group of cylinders substantially simultaneously. In this approach, no fuel is delivered to the deactivated cylinders and their associated intake and exhaust valves are kept closed as long as the cylinders remain deactivated.

Another engine control approach that varies the effective displacement of an engine is referred to as "skip fire" engine control. In general, skip fire engine control contemplates selectively skipping the firing of certain cylinders during selected firing opportunities. Skip fire engine operation is distinguished from conventional variable displacement engine control in which a designated set of cylinders are deactivated substantially simultaneously and remain deactivated as long as the engine remains in the same variable displacement mode. Thus, the sequence of specific cylinders firings will always be exactly the same for each engine cycle during operation in a variable displacement mode (so long as the engine remains in the same displacement mode), whereas that is often not the case during skip fire operation.

In general, skip fire engine operation facilitates finer control of the effective engine displacement than is possible using a conventional variable displacement approach. For example, firing every third cylinder in a 4 cylinder engine would provide an effective displacement of $\frac{1}{3}^{rd}$ of the full engine displacement, which is a fractional displacement that is not obtainable by simply deactivating a set of cylinders. Conceptually, virtually any effective displacement can be obtained using skip fire control, although in practice most implementations restrict operation to a set of available firing fractions, sequences or patterns.

The Applicant has developed a technology referred to as dynamic skip fire in which firing decisions are made on a cylinder firing opportunity by cylinder firing opportunity basis. In many applications, a single firing decision is made at a time, whereas in others, firing decisions for small sets of cylinders may be made at the same time (e.g., a engine cycle by engine cycle basis). Various aspects of dynamic skip fire are described in a number of patents including U.S. Pat. Nos. 7,954,474, 7,886,715, 7,849,835, 7,577,511, 8,099,224, 8,131,445, 8,131,447, 8,616,181, 8,701,628, 9,086,020, 9,328,672, 9,387,849, 9,399,964, 9,512,794, 9,745,905, and others, each of which is incorporated herein by reference. The present application describes additional engine control features and enhancements that can further improve engine performance in a variety of applications.

SUMMARY

A variety of engine controllers and methods are described for controlling engines operating in a cylinder output level modulation mode.

In one aspect, when a transition is made to a new firing density that could potentially have multiple different high/low/skip sequences, the phase of a high/low fire sequence for the new firing density is set based on the phase of the associated firing sequence. This ensures that a preferred high/low/skip sequence for the new firing density is utilized. In some embodiments, a first accumulator is used to determine when firings are appropriate vs. when skips are appropriate and a second accumulator is used to determine when high firings are appropriate vs. when low firings are appropriate. In some embodiments, an engine controller is configured to set the second accumulator to a designated value that is based on a value held in the first accumulator when the engine enters the selected firing density. In some embodiments, the first and second accumulators are both first order sigma delta converters, or their functional equivalents.

In another aspect, transitions between different effective firing densities are managed by gradually ramping an effective firing density from a first effective firing density to a second effective firing density over a plurality of firing opportunities. In some embodiments the operational firing fraction and the operational high/low fraction are ramped in parallel. In others, only one of the operational firing fraction and the operational high/low fraction are ramped at a time.

In some embodiments, the operational effective firing density is incremented or decremented each firing opportunity during the gradual ramping of the operational effective firing density. In some embodiments, the operational effective firing density is incremented or decremented by a substantially constant amount each firing opportunity during a majority of the transition In some embodiments, the ramping of a first one of the operational firing fraction and the operational high/low fraction is accomplished in two or more ramping segments and is paused at one or more predetermined intermediate holding fraction(s). The other parameter is ramped during the pause(s) between the ramping segments.

In another aspect, rapid large torque changes can be implemented in part by immediately changing the operational high/low fraction in response to a command to increase or reduce the desired engine torque.

BRIEF DESCRIPTION OF THE DRAWINGS

The invention and the advantages thereof, may best be understood by reference to the following description taken in conjunction with the accompanying drawings in which:

FIG. 3 illustrates portions of a representative firing density encoding index table.

FIG. 4 illustrates a representative firing density sequence selection table.

In the drawings, like reference numerals are sometimes used to designate like structural elements. It should also be appreciated that the depictions in the figures are diagrammatic and not to scale.

DETAILED DESCRIPTION

Figure 1:
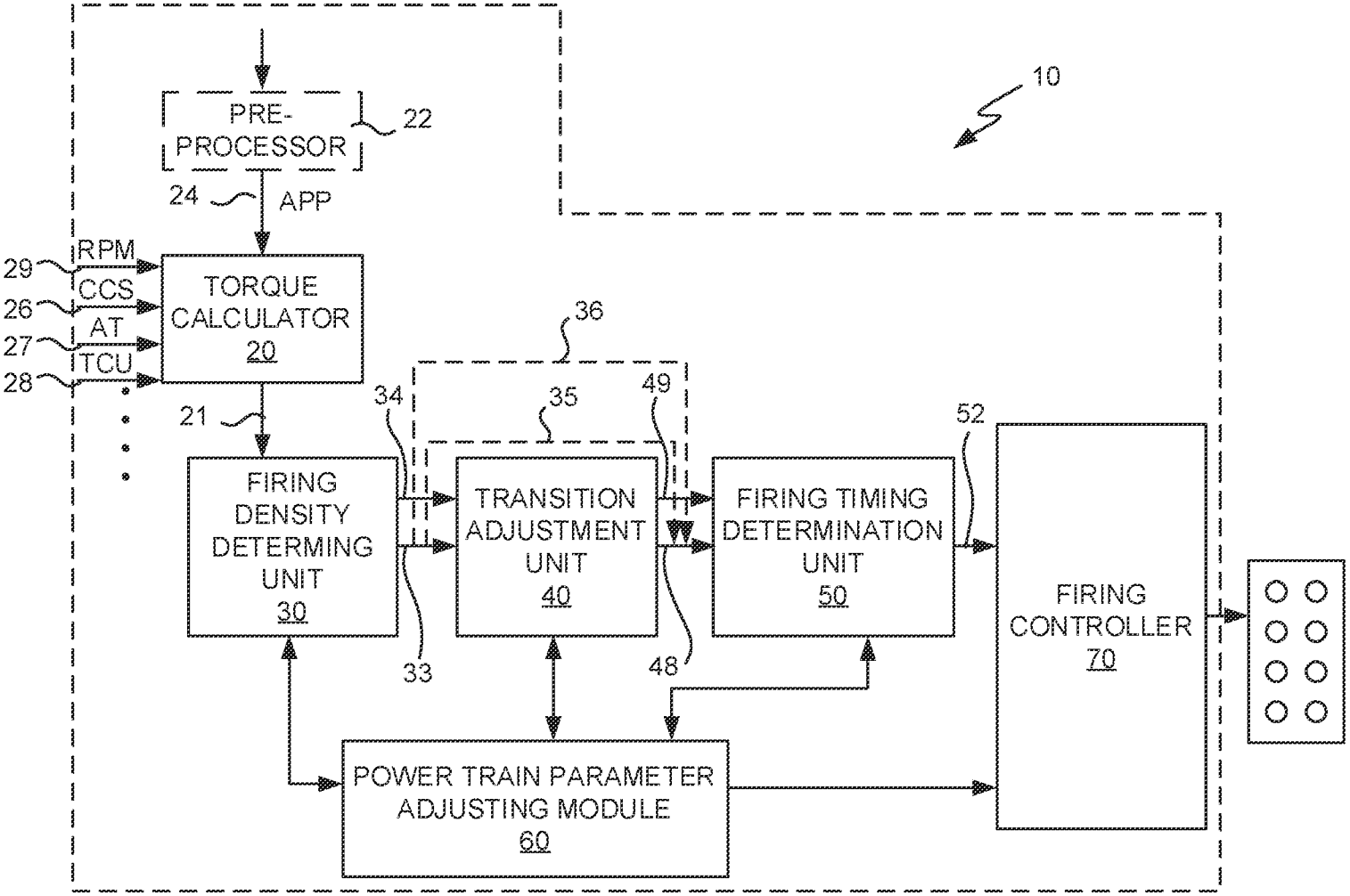
FIG. 1 is a block diagram of a cylinder output level modulation engine controller in accordance with one embodiment.

In some applications referred to as multi-level skip fire engine operation, individual working cycles that are fired may be purposely operated at different cylinder outputs levels. Multi-level skip fire engine operation is described in detail in U.S. Pat. No. 9,399,964, which is incorporated herein by reference. In general, multi-level skip fire contemplates that individual working cycles of an engine may be selectively fired or skipped during individual cylinder working cycles and that fired working cycles may be purposely operated at different cylinder outputs levels in an interspersed manner Cylinders are typically deactivated during skipped working cycles so that air is not pump through cylinders during the skipped cycles and there are a variety of different valve actuation management schemes that may be used to accomplish such deactivation.

The individual cylinder control concepts used in dynamic skip fire can also be applied to dynamic multi-charge level engine operation in which all cylinders are fired, but individual working cycles are purposely operated at different cylinder output levels. Skip fire, multi-level skip fire, and multi-charge level engine operation may collectively be considered different types of cylinder output level modulation engine operation in which the output of each working cycle (e.g., skip/fire, high/low, skip/high/low, etc.) is varied during operation of the engine. Sometimes the firing decisions are made dynamically on an individual cylinder working cycle by working cycle (firing opportunity by firing opportunity) basis or in small sets such as on an engine cycle by engine cycle basis.

When an engine/engine controller combination is capable of supporting multi-level skip fire operation with two distinct firing levels, there are a total of seven different basic operating modes that are possible. These include:

1. All-cylinder High Fire
2. All-cylinder Low Fire
3. High Fire+Skip
4. Low Fire+Skip
5. High Fire+Low Fire
6. High Fire+Low Fire+Skip
7. All Skips Some engines/engine controllers will be capable of operating in all six of these modes. Some less full featured engines/engine controllers that still support multi-level firings may support only some of those operating modes. For example, some engines/cylinder output level modulation controllers support multiple firing levels but not skips. For example, such engines may only support All-Cylinder High Fire, All-Cylinder Low Fire, and High Fire+Low Fire operating modes. Others may add Low Fire+Skip and/or High Fire+Skip.

In some engines it is conceptually rather easy to support multi-level operation. For example, different output levels may be accomplished in many compression engines (e.g. diesel engines) by varying the fuel charge between different cylinders or cylinder working cycles. Engines that require stoichiometric air/fuel ratios (e.g., most gasoline engines) generally require the ability to vary the air charge in addition to varying the fuel charge in order to support multi-level operation. Engines having electronically actuated intake valves can theoretically vary the air charge on a cylinder firing opportunity by firing opportunity basis. However electronically actuated valves have not experienced much commercial success at this point.

Engines having cam actuated valves can support multi-level operations using a variety of different schemes. Some such schemes contemplate the use of multiple different cam lobes that can be readily switched between on an individual cylinder working cycle basis. In some embodiments, a first cam lobe is generally associated with an Otto cycle type working cycle, a second cam lobe is associated with a Miller or Atkinson cycle type working cycle that runs efficiently using lower air charges. In some implementations, a third cam lobe may be used for deactivated or skipped working cycles. Some implementations involve the use of two independently actuatable intake valves such that one, both or neither of the valves may be actuated for a given working cycle. Of course multi-level engine operation can be supported using a variety of other techniques so long as the output level of at least some of the cylinders can be controlled differently than other cylinders. A few such techniques are described in the referenced '964 patent.

When multi-level skip fire engine control is contemplated, the engine's state at any time can be characterized by a Firing Fraction (FF) and a High Fraction (HF). The Firing Fraction indicates the proportion of firing events (fired cylinder working cycles) out of a given total number of possible firing opportunities (total cylinder working cycles). The High Fraction indicates the proportion of High Firings events in a given period to the total number of firings (either high or low) that occur in that given period.

When the use of multiple non-zero firing levels is contemplated (e.g., during multi-level skip fire or multi-charge level operation of an engine), it is often helpful to consider an effective firing density (eFD) which correlates to the percentage or fraction of the cylinders that would be fired at a high or reference output. For example, if half of the cylinders are fired at a cylinder output level of 70% of a full firing output and the other half are fired at the full firing output level, then the effective firing density would be 85%. This corresponds to a Firing Fraction of 1.0 and a High Fraction of 0.5. If the "Low" cylinder output were reduced to 60% of a full firing, then the effective firing density would be reduced to 80% in this example.

In another example, if a quarter of the cylinders are fired at a cylinder output level of 70% of a full firing output, another quarter are fired at the full firing output level, and the other half are skipped, then the effective firing density would be 42.5%. This corresponds to a Firing Fraction of 0.5 and High Fraction on 0.5. In yet another example, if traditional skip fire operation is used (i.e., firing a designated percentage of the firing opportunities), then the effective firing density may represent the percentage of the cylinders that are actually fired. That is, the effective Firing Density is the same as the Firing Fraction.

The Applicant has previously described a variety of skip fire engine controllers and other cylinder output level modulation controllers including engine controllers that support multi-level skip fire operation. One cylinder output level modulation engine controller 10 suitable for implementing the inventions described herein is functionally illustrated in FIG. 1. Although a particular implementation is shown, it should be appreciated that the engine controller can be implemented in many other forms. The illustrated engine controller 10 includes a torque calculator 20, a firing density determining unit 30, a transition adjustment unit 40, a firing timing determination unit 50, a power train parameter adjusting module 60 and a firing controller 70. For the purposes of illustration, the described components are all shown as integral components of an engine control unit (ECU) 10 that is also capable of directing engine operation in a conventional, all cylinder operation manner. However, it should be appreciated that in other embodiments the functionalities of some or all of the identified components may be separated into a separate cylinder output level modulation controller.

Selected power train parameters are associated with specific effective firing density sequences. In some embodiments, each effective firing density sequence has an associated drive train slip that is used as the target drive train slip when the engine operates at the associated effective firing density sequence. In some embodiments, the target drive train slip for at least some of the firing fraction and high/low fraction combinations varies based at least in part on another power train parameter, as for example, engine speed.

The output of an engine is quickly changed at least in part by immediately changing an operational high/low fraction in response to a change in requested torque. In some instances, torque reductions are accomplished at least in part by reducing the high fraction to zero. In some embodiments, the operational high/low fraction is immediately reduced in response to a gear shift command or a traction control event. In other instances, commanded torque increases are accomplished at least in part by increasing the high fraction to one. In some instances, the operational firing fraction is immediately changed in parallel with the change in the operational high/low fraction.

The torque calculator 20 is arranged to determine the desired engine torque at any given time based on a number of inputs. The torque calculator outputs a requested torque 21 to the firing density determining unit 30. The firing density determining unit 30 is arranged to determine a firing density that is suitable for delivering the desired torque based on the current operating conditions and outputs an indication of a firing density that is appropriate for delivering the desired torque. As will be described in more detail below, in some implementations, the firing density is outputted in terms of a desired firing fraction 33 and a desired high fraction 34. The firing timing determining unit 50 is responsible for making actual cylinder firing decisions. That is, it determines whether specific cylinder working cycles will be skipped or fired, and when fired, at what level the firing should be at when multi-level firings are supported (e.g., high/low; high/medium/low, etc.). As such, the firing timing determining unit 50 outputs a series of firing decisions 52 that define a firing sequence that delivers the desired firing density. The firing decisions 52 are passed to firing controller 70 which implements the firing commands The torque calculator 20 receives a number of inputs that may influence or dictate the desired engine torque at any time. In automotive applications, one of the primary inputs to the torque calculator is the accelerator pedal position (APP) signal 24 which indicates the position of the accelerator pedal. In some implementations the accelerator pedal position signal is received directly from an accelerator pedal position sensor (not shown) while in others an optional preprocessor 22 may modify the accelerator pedal signal prior to delivery to the skip fire controller 10. Other primary inputs may come from other functional blocks such as a cruise controller (CCS command 26), the transmission controller (AT command 27), a traction control unit (TCU command 28), etc. There are also a number of factors such as engine speed that may influence the torque calculation. When such factors are utilized in the torque calculations, the appropriate inputs, such as engine speed (RPM signal 29) are also provided or are obtainable by the torque calculator as necessary.

Further, in some embodiments, it may be desirable to account for energy/torque losses in the drive train and/or the energy/torque required to drive engine accessories, such as the air conditioner, alternators/generator, power steering pump, water pumps, vacuum pumps and/or any combination of these and other components. In such embodiments, the torque calculator may be arranged to either calculate such values or to receive an indication of the associated losses so that they can be appropriately considered during the desired torque calculation.

The nature of the torque calculation will vary with the operational state of the vehicle. For example, during normal operation, the desired torque may be based primarily on the driver's input, which may be reflected by the accelerator pedal position signal 24. When operating under autonomous or cruise control, the desired torque may be based primarily on the input from an autonomous or cruise controller. When a transmission shift is imminent, a transmission shifting torque calculation may be used to determine the desired torque during the shifting operation. When a traction controller or the like indicates a potential loss of traction event, a traction control algorithm may be used to determine the desired torque as appropriate to handle the event. In some circumstances, depression of a brake pedal may invoke specific engine torque control, including, when appropriate, engine braking. When other events occur that require measured control of the engine output, appropriate control algorithms or logic may be used to determine the desired torque throughout such events. In any of these situations, the required torque determinations may be made in any manner deemed appropriate for the particular situation.

The firing density sequence used during cylinder output level modulation of an engine is determined by reference to a firing density sequence selection table. In some embodiments, the firing density sequence selection table is accessed via indexes based on operating parameters such as engine speed and engine load. Operational firing densities may be encoded in an index table.

For example, the appropriate torque determinations may be made algorithmically, using lookup tables based on current operating parameters, using appropriate logic, using set values, using stored profiles, using any combinations of the foregoing and/or using any other suitable approach. The torque calculations for specific applications may be made by the torque calculator itself, or may be made by other components (within or outside the ECU) and simply reported to the torque calculator for implementation.

The firing density determining unit 30 receives requested torque signal 21 from the torque calculator 20 and other inputs such as engine speed and various power train operating parameters and/or environmental conditions. The firing density determining unit 30 is arranged to select the desired operational firing density to deliver the requested torque based on current condition and various factors that the controller designer considers important. Often these selections are based heavily on factors such as fuel economy, NVH considerations and emissions control. In the embodiment shown in FIG. 1, the firing density determining unit 30 outputs two parameters: the desired operational firing fraction (FF) 33 and the desired operational high fraction (HF).

In some implementations, it is desirable to constrain the engine to operate at one of a fixed set of firing fractions. For example, a skip fire engine controller that permits the use of any firing fraction between zero (0) and one (1) having an integer denominator of five (5) or less would have a total of 11 possible unique firing fractions. These would include: 0, 1/5, 1/4, 1/3, 2/5, 1/2, 3/5, 2/3, 3/4, 4/5 and 1. Similarly, a skip fire controller that can be operated at any firing fraction between zero (0) and one (1) having an integer denominator of nine (9) would have a set of 29 potential unique firing fractions. These would include, as firing density increases: 0, 1/9, 1/8, 1/7, 1/6, 1/5, 2/9, 1/4, 2/7, 1/3, 3/8, 2/5, 3/7, 4/9, 1/2, 5/9, 4/7, 3/5, 5/8, 2/3, 5/7, 3/4, 7/9, 4/5, 5/6, 6/7, 7/8, 8/9 and 1.

In parallel, the high fraction may also be constrained to a designated set of available fractions. For example, the high fraction may be limited to any fraction between zero (0) and one (1) having an integer denominator of five (5) or less. Again, these would include: 0, 1/5, 1/4, 1/3, 2/5, 1/2, 3/5, 2/3, 3/4, 4/5 and 1).

Since the available set of firing densities is limited, various power train operating parameters such as fuel charge, mass air charge (MAC) and/or spark timing will typically need to be varied to ensure that the actual engine output matches the desired output. In the illustrated embodiment, a power train parameter adjusting module 60 is provided that cooperates with the firing density determining unit 30. The power train parameter adjusting module 60 directs the firing controller 70 to set selected power train parameters appropriately to ensure that the actual engine output substantially equals the requested engine output at the commanded effective firing density. By way of example, the power train parameter adjusting module 60 may be responsible for determining the desired MAC, spark timing, cam settings, throttle settings, exhaust gas recirculation levels and/or other engine settings that are desirable to help ensure that the actual engine output matches the requested engine output. Although the powertrain parameter adjusting module 60 is illustrated as a separate component, it is often implemented as a part of firing controller 70. Of course, in other embodiments, the power train parameter adjusting module 60 may be arranged to directly control various engine settings. In diesel and other compression engines that don't utilize spark or vary the cam timing, exhaust gas recirculation may be controlled by the power train parameter adjusting module.

The firing timing determining module 50 is arranged to issue a sequence of firing commands 52 that cause the engine to deliver the percentage of firings dictated by commanded firing fraction 48 with the percentage of high vs. low firings as dictated by commanded high fraction 49. The firing sequence can be determined using any suitable approach. In some preferred implementations, the firing decisions are made dynamically on an individual firing opportunity by firing opportunity basis which allows desired changes to be implemented very quickly. Applicant has previously described a variety of skip fire firing timing determining units that are well suited for determining appropriate firing sequence based on potentially time varying requested firing density or engine outputs. Many such firing timing determining units are based on sigma delta conversion which is well suited for making firing decisions on a firing opportunity by firing opportunity basis.

When an engine transitions to an effective firing fraction that has more than one possible high/low/skip sequence, an operational phase of the operational high/low pattern is set relative to the operational phase of the firing fraction to thereby cause the engine to utilize a desired high/low/skip sequence. Preferably this is accomplished without requiring that the skip/fire firing sequence initiate in any particular phase. In some embodiments, a first accumulator is used to determine when firings are appropriate and when skips are appropriate and a second accumulator is used to determine when high firings are appropriate and when low firings are appropriate. When the dual accumulator approach is used, the high/low accumulator is reset to a designated value based on a value held in the firing fraction accumulator. In some embodiments, both accumulators are first order sigma delta converters. In others, a lookup table is used to determine the operational phase of the high/low pattern based on the operational phase of the firing fraction.

Figure 2:
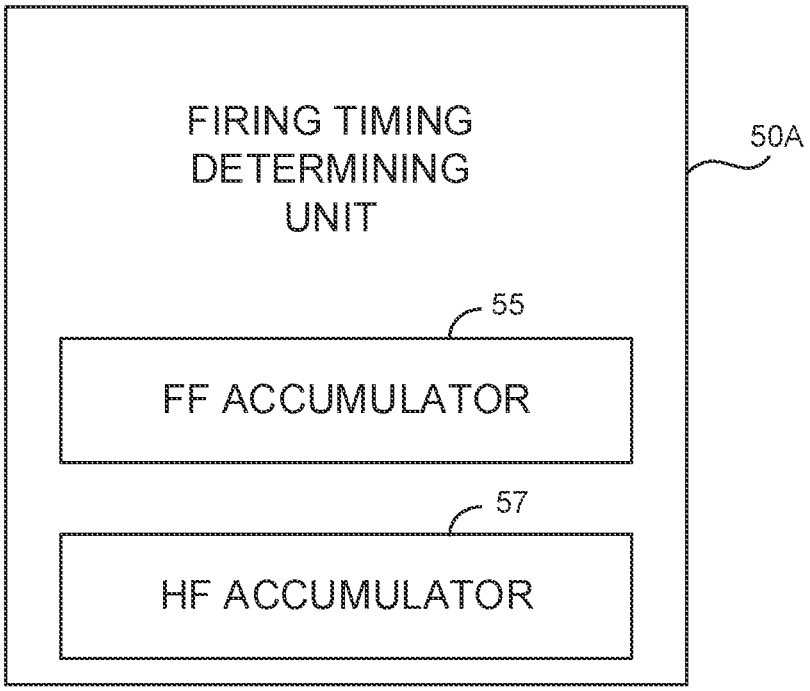
FIG. 2 is a block diagram of a firing timing determining unit in accordance with one embodiment.

A particular firing timing determining unit 50A is illustrated in FIG. 2. The illustrated firing timing determining unit utilizes a pair of accumulators. A first one of the accumulators, referred to as FF accumulator 55, determines which working cycles to skip and which to fire. A second one of the accumulators, referred to as HF accumulator 57 determines whether any particular firing is to be fired high or low. In some embodiments, the FF and HF accumulators take the form of first order sigma delta converters, although other types of converters can be used in other applications. The converters may be implemented algorithmically on a processor, via programmable logic, in integrated circuits, as discrete logic or in any other suitable form. In other implementations, pattern generators or predefined patterns may be used to facilitate delivery of the desired firing density.

Although a dual accumulator firing timing determining module is shown, the firing sequence may be generated in variety of ways, such as using a multi-level sigma-delta converter, through the use of one or more look up tables, using a state machine or using other suitable techniques.

The firing timing determination unit 50 outputs sequence of firing commands 52 that indicate whether specific cylinder working cycles are to be fired or skipped, and if fired, whether they are to be fired high or low. The firing commands are passed to firing controller 70 or another module such as a combustion controller (not shown in FIG. 1) which orchestrates the actual firings. A significant advantage of using a sigma delta converter or an analogous structure is that it inherently includes an accumulator function that tracks the portion of firing that have been requested but not yet delivered. Such an arrangement helps smooth transitions by accounting for the effects of previous fire/no fire decisions.

Abrupt transitions between firing densities can lead to undesirable torque surges or dips, i.e. undesirable NVH. The torque surge/dip arises since often the change in torque request, at least during the transition, is smaller than the change in the firing fraction. The firing fraction change would thus cause the engine to overshoot/undershoot the requested torque level. Therefore, in the embodiment illustrated in FIG. 1, transition adjustment unit 40 is arranged to help mitigate vibrations and torque surges/dips associated with step changes in the requested firing density. When a step change in requested firing fraction occurs, the transition adjustment unit 40 has the effect of spreading the change in firing density over a short period. This "spreading" can help smooth transitions between different commanded firing densities and can help compensate for various delays associated with manifold filling. These may include mechanical delays in the changing of the engine parameters and/or inertial type manifold filling/emptying delays. In general, the transition adjustment unit receives requested firing fraction 33 and requested high fraction 34 and outputs commanded firing fraction 48 and commanded high fraction 49. When the requested firing fraction is at steady state, the commanded firing fraction 48 is the same as the requested firing fraction 33 and the commanded high fraction 49 is the same as requested high fraction 34. However, when a transition occurs, the effective firing density may be ramped from the previous requested firing density to the target firing density.

If the nature of the transition is such that the transition adjustment unit imposed delays are acceptable, smoother operation can be obtained by using such an arrangement. However, if the nature of the transition is such that a quicker response is desired (as for example, when the driver stomps on the accelerator pedal or during transmission shifts or traction control events), it may be desirable to bypass or modify the settings of the transition adjustment unit 40 to provide a quicker response. Therefore, some implementations incorporate separate "fast path" and "slow path" approaches for managing firing density change requests. In such applications, the slewing function of the transition adjustment unit 40 can effectively be bypassed for "fast path" responses and used in "slow path" changes. In some embodiments, only one of the high fraction or the firing fraction is changed immediately via the fast path. More generally, the transition adjustment unit 40 characteristics may vary depending on inputs governing the desired transition, e.g. the desired firing fraction slew rate may vary with the rate of change and/or magnitude of change of the accelerator pedal position.

When multi-level skip fire operation is supported, there can be a large number of potential operational firing density states. For example, a cylinder output level modulation engine controller that supports all firing fractions having a denominator of 5 or less and all high fractions having a denominator of 5 or less would have a total of 110 potential operational firing density states in addition to a no firings state. Although such a large number of firing density states may potentially be available, in practice, many firing density determining units will only utilize a subset of those states.

The availability of such a large number of potential operational firing density states can add significant complexity to the overall powertrain control law. One way to help mitigate some of this complexity is to associate certain engine or powertrain parameters with specific firing density states. To facilitate such an implementation, it can be helpful to encode all of the available firing density states. There are a number of ways that the available firing density states can be encoded. For example, a firing density encoding index table or other suitable data structure construct can be used to encode the available operational firing density states.

FIG. 3 illustrates portions of a representative firing density encoding index table 200 in accordance with one embodiment. The illustrated encoding table is for a cylinder output level modulation or multi-level skip fire engine controller that supports all firing fractions having a denominator of 5 or less and high fractions having a denominator of 5 or less. As such, the illustrated table has a total of 111 potential operational firing density states, with each state having an associated sequence identifier 203. Analogous encoding tables for cylinder output level modulation engine controllers that support different numbers of firing levels, different firing fractions and/or different high fractions would have corresponding numbers of entries. In the illustrated embodiment, all of the potential firing fraction/high fraction combinations are represented. However, it should be appreciated that in some implementation, the engine controller may not be allowed to utilize all of the potential firing fraction/high fraction combinations. In such implementations, combinations that are not allowed may be eliminated from the encoding table. Similarly, if other combinations are supported, they can be added to the encoding table.

As will be appreciated by those familiar with the art, there are a number of parameters that will affect the engine's output and fuel consumption efficiency. These include factors such as load, engine speed, manifold pressure, intake cam phasing, exhaust cam phasing, torque converter slip, fuel charge, spark timing (e.g., spark retard), gear, etc. Multi-level skip fire adds firing fraction and high low fraction as additional operating variables. Given the engine's relatively large number of degrees of freedom available to optimize fuel consumption, a tabulated approach to firing density sequence selection can be useful due to its computational efficiency. One such approach is described next with reference to FIG. 4.

In some embodiments, the engine is mapped to identify a preferred operational firing density state for any given operational engine speed and engine load (requested/desired output) combination. The preferred operational firing density state is typically based on fuel efficiency, NVH characteristics and other factors considered relevant by the engine designer. This information may be tabulated in a lookup table such as the Firing Density Sequence Selection Table 220 illustrated in FIG. 4 or using other suitable data structures. The illustrated Firing Density Sequence Selection Table 220 is a two dimensional table that utilizes engine speed 222 and engine load 224 as indices. The table entries 230 identify the sequence identifier 203 associated with the preferred operation firing density state for use when the engine is operating in the corresponding operating region (speed/load). During operation of the engine in a cylinder output level modulation mode, the engine controller (e.g. firing density determining unit 30) looks up the desired firing density state based on the current engine speed and engine load. The controller (e.g. firing timing determination unit 50) then directs operation of the engine using the firing fraction and high fraction associated with the identified state.

In some embodiments, a separate Firing Density Sequence Selection Table 220 is provided for each gear to provide more refined control, although that is not required. Alternatively, a three dimensional table may be provided with gear or gear ratio as a third index. Of course, in other embodiments, other suitable variables may be used as indices for accessing the table in place of, or in addition to, the described engine speed, engine load and/or transmission gear indices.

In general, interpolation is not allowed in the use of the Firing Density Sequence Selection Table 220. This provides built-in hysteresis based on the specified engine speed and load intervals. For example, consider an engine operating at an engine speed of 2000 RPM and a requested torque of 65 Nm. Based on the specific table illustrated in FIG. 4, the engine would be operating at an operational firing density state 203(*a*) (identified as sequence ID 65 in the illustrated table). Once operating at that state, the engine would continue operating in that state unless or until the engine speed increases to at least 2500 RPM or decreases to 1750 RPM or below, or the requested torque increases to at least 70 Nm or decreases to 60 Nm or below. It should, of course, be appreciated that the specific table show in FIG. 4 is for illustrative purposes only and that the size of the steps in the table may be widely varied to meet the needs of any particular engine design. If the engine speed increases to 2500 RPM or greater at the same torque request, the operational firing density will transition to sequence ID 85. Once the new state is achieved, the engine will remain in that state until unless or until the engine speed increases to at least 3000 RPM or decreases to 2000 RPM or below, or the requested torque increases to at least 70 Nm or decreases to 60 Nm or below. In general, the operational firing density sequence may continue to be determined in the same manner as long as the engine remains in a cylinder output modulation operating mode.

The Firing Density Sequence Selection Table 220 illustrated in FIG. 4 is well suited for use under normal operating conditions. However, there may be a number of special circumstances or events in which use of a particular firing density sequence may be desirable. These could include engine warm-up, engine idle, engine startup (cranking), transmission shift events, traction control events, transitioning out of a fuel or cylinder cutoff mode, engine braking, managing emissions, etc. When condition dictates, the engine controller may command operation using a specific firing density sequence. In some embodiments, the desired firing density sequence may be designated simply by the corresponding sequence ID 203.

As suggested above, when multiple firing levels are supported, it can be helpful to associate certain engine or powertrain parameters with specific firing density states. That is, each (or at least some) of the available operational firing density state may have one or more associated (predetermined) powertrain settings. For example, driveline slip is sometimes controlled to help mitigate powertrain vibration during skip fire operation of an engine. In some embodiments, each specific operational firing density state has an associated (predetermined) driveline slip that is used any time that operational firing density state is used. The most common slip control device is a torque converter clutch (TCC), and therefore driveline slip is discussed primarily in terms of TCC slip herein. However, it should be appreciated that there are other driveline components that may have the ability to control driveline slip which may be controlled in a similar manner Such devices include Dual Clutch Transmissions (DCT), automated manual transmissions and others.

In some embodiments, predefined TCC slip settings associated with any particular operational firing density state are included as additional values stored in the firing density encoding table 200. In that way, the appropriate target TCC slip setting may be provided in parallel with the desired firing density state is determined. In other embodiments, the TCC slip settings may be stored in separate TCC slip tables or other suitable data structures that are indexed, at least in part, by sequence ID 203. In some embodiments, the TCC slip settings may be stored in multi-dimensional tables that utilize additional indices as well such as gear, engine speed, or other engine or powertrain settings, road or driving conditions, ambient conditions, etc. In still other embodiments, the TCC slip settings can be included as extra values in table entries 230 of Firing Density Sequence Selection Table 220. Of course other predefined powertrain settings may be associated with specific firing density sequences in the same manner Predefining selected powertrain settings in this way can help simplify the overall powertrain control law when multiple firing levels are supported.

When changing between firing density sequences having different TCC slip settings the TCC slip transitions may be managed in conjunction with the firing fraction and/or high fraction transitions. Such transitions can be handled somewhat similarly to TCC slip transitions made in association with firing fraction transitions during ordinary skip fire control. By way of example, Applicant's Pat. Nos. 9,267,454, 9,878,718 and 10,259,461, describe a few suitable skip fire TCC slip management schemes. Each of these applications is incorporated herein by reference.

Firing Control and Managing Transitions

One area of particular concern in skip fire operation is managing transitions between different operational firing fractions. Multi-level skip fire adds the additional challenge of managing transitions between different high fractions. Some implementations of dynamic skip fire described in some of Applicant's earlier patent applications utilize an accumulator or equivalent mechanism to track the portion of a firing that is due, but not yet commanded or vice versa. In general, each time a firing opportunity arises, the accumulator adds the currently requested firing fraction to an accumulated carryover value. If the sum is less than 1, the cylinder is not fired and the sum is carried over to be used in the determination of whether to skip or fire the next firing opportunity. If the sum exceeds 1, the corresponding cylinder is fired and the value of 1 is subtracted from the accumulated value. The process is then repeated for each firing opportunity. The use of accumulators and similar structures, including first order sigma delta conversion is described in U.S. Pat. No. 8,099,224 which is incorporated herein by reference. There are several advantages of using the accumulator approach. One advantage is that it inherently spreads out the firings into the most evenly spaced sequence possible for any given inputted firing fraction. Another advantage is that the accumulator inherently helps smooth transitions between firing fractions due to the inherent spreading of the firings.

In some embodiments of multi-level skip fire control, a second accumulator is used to make high/low firing decisions. The firing timing determining unit 50A illustrated in FIG. 2 utilizes such an approach. Like the firing fraction accumulator 55, the high/low accumulator 57 may take the form of a first order sigma delta converter. Analogously to the firing fraction accumulator 55, any time a firing is commanded, the high/low accumulator 57 may be incremented by the current operational high/low fraction. When the sum in the high/low accumulator's value is less than 1, the corresponding cylinder is fired "low". When the sum in the high/low accumulator is greater than 1, the corresponding cylinder is fired "high" and a value of 1 is subtracted from the accumulated value. In this implementation, the high/low accumulator 57 is not incremented during skipped working cycles. The use of a high/low accumulator 57 can help spread the high and low firings evenly. Of course, the high/low determinations can be made using other constructs as well.

When multi-level skip fire is implemented, there may be multiple high/low (H/L) sequences that can implement a specific high fraction. For example, a FF of ⅗ and a HF of ⅓ can produce three unique sequences that all have evenly spaced skips. These include: S-H-S-L-L; S-H-L-S-L; and S-L-H-S-L. These different sequences are not equal from the standpoint of either cylinder airflow dynamics or NVH characteristics. As such, one of the possible H/L sequences will often be preferred over the others. In the specific example above, that would typically be the S-H-S-L-L sequence since the torque from the firings is more evenly balanced in that sequence. Therefore, it will often be desirable to guarantee that the specific desired sequence is used any time a multi-level skip fire sequence having multiple potential high/low sequences is entered.

In embodiments that utilize a high/low accumulator as described, the desired high/low/skip sequence can be ensured by setting the high/low accumulator to an appropriate level based on the current value in the skip/fire accumulator when a new sequence is entered. This may be achieved using a parameter referred to as the HF offset.

For any given firing fraction, the firing sequence that will be generated by a first order sigma delta converter is known due to the nature of sigma delta conversion. For example, when the FF=⅗, the firing sequence will always be S-F-S-F-F. The phase of the firing sequence at any time can be uniquely determined based on the carryover value in the accumulator. This characteristic is illustrated in the first two columns of Table 1 below. The first column of Table 1 shows the carryover value in the firing fraction accumulator. Since the firing fraction is ⅗, a value of 0.6 is added to the FF accumulator each firing opportunity. When the carryover FF accumulator value is a less than 0.2 (Col. 1), the value in the FF accumulator for the next firing opportunity will be at least 0.6 and less than 0.8. This dictates that the next firing will be a skip and that such skip is the first skip in the firing sequence S-f-s-f-f (note the active firing decision is capitalized, bolded and underlined in the table). The next firing opportunity, another 0.6 is added to the FF accumulator which results in an accumulator value in the range of $1.2 \leq X < 1.4$. Since the accumulator value exceeds 1, a fire is commanded and the accumulator value is decremented by one (1) leaving a carryover valued in the range of $0.2 \leq X < 0.4$. When another 0.6 is added to the FF accumulator for the next firing opportunity, the value in the FF accumulator remains below 1.0 which results in another skip and so on as illustrated in Table 1.

TABLE 1

| Carryover FF Accumulator Value | Phase in Firing Sequence | Desired Phase In H/L Seq. | Required Carryover HF Accumulator Value |
|---|---|---|---|
| $0.0 \leq X < 0.2$ | **S**-f-s-f-f | **S**-h-s-l-l | $2/3 \leq Y < 1.0$ |
| $0.6 \leq X < 0.8$ | s-**F**-s-f-f | s-**H**-s-l-l | $2/3 \leq Y < 1.0$ |
| $0.2 \leq X < 0.4$ | s-f-**S**-f-f | s-h-**S**-l-l | $0.0 \leq Y < 1/3$ |
| $0.8 \leq X < 1.0$ | s-f-s-**F**-f | s-h-s-**L**-l | $0.0 \leq Y < 1/3$ |
| $0.4 \leq X < 0.6$ | s-f-s-f-**F** | s-h-s-l-**L** | $1/3 \leq Y < 2/3$ |

When a transition is made to a new firing fraction, the FF accumulator is preferably not reset. Rather, the value added for the next firing opportunity is simply the new commanded firing fraction. This characteristic helps smooth transitions between firing fractions. It should be appreciated that the phase of the skip/fire in the context of the newly entered firing fraction can readily be determined by reference to the carryover FF accumulator value.

In a generally similar manner, when a high fraction (HF) accumulator is used, the phase of any given H/L sequence is dictated by the current value in the HF accumulator 57. In general, the value in the HF accumulator when a new firing density sequence is first entered will be pseudo random. Therefore, something must be done to synchronize the high fraction with the firing fraction to ensure that the appropriate HF phase is entered. This can be accomplished by setting (resetting) the value of the HF accumulator based on the current value of the FF accumulator. Table 1 shows the range of appropriate HF values for corresponding ranges of FF accumulator values for the example of FF=⅗ and HF=⅓. Any value within any of the listed HF accumulator value ranges can be used for the corresponding range of FF accumulator values. For example, in some embodiments a midpoint of the range may used, in others the lowest point in the range is used and in still others, another selected point in the range is used. Whichever value within the range is used is referred to as the "HF offset" that corresponds to the associated FF accumulator value range.

It should be apparent that the HF offset is used for synchronization purposes. Specifically, when the engine enters a new firing density sequence, the HF offset value associated with the FF accumulator value of the new firing density sequence is loaded into the HF accumulator. That is, the HF accumulator is reset to the appropriate HF offset value. In some embodiments, the sequence ID 203 and the current FF accumulator value may be used as indices to look up the HF offset for any particular engine state in an HF offset table (not shown). In other embodiments, the HF offsets may be additional entries in the firing density encoding index table 200. Of course, the appropriate HF offset values can be retrieved or determined in other suitable manners as well.

Although the use of accumulators is quite helpful in managing transitions, there are a number of other schemes that have been proposed to further smooth transitions between firing fractions. For example, in some designs, firing fraction transitions are implemented gradually, preferably in a manner that relatively closely tracks manifold filling dynamics By way of example, U.S. Pat. No. 9,745,905, which is incorporated herein by reference, describes several such techniques.

Generally analogous approaches can be used by transition adjustment unit 40 to manage multi-level skip fire transitions, although a number of multi-level specific variations may be made to further smooth specific types of transitions in the context of multi-level engine operation. In the engine controller illustrated in FIG. 1, firing density determining unit 30 is responsible for determining the desired firing fraction and high fraction (i.e., requested firing fraction 33 and requested high fraction 34). Those requests are passed to transition adjustment unit 40. When the requested firing density changes, the transition adjustment unit 40 doesn't always immediately pass the new request to the firing timing determining unit 50. Rather, in many situations, it gradually changes the commanded firing fraction 33 and the commanded firing fraction and/or the commanded high fraction in a manner that gradually ramps the effective firing density to the target values. In some implementations a brief delay is also included before initiating the slewed transition to help compensate for delayed intake manifold dynamics. There are a number of different ramping strategies that may be applied in appropriate circumstances. A few specific ramping strategies that have been found to be useful are described next.

When the target HF is the same as the current HF, but the target FF is different than the current FF, only the firing fraction is ramped. Such ramping may be accomplished in any desired manner By way of example, the techniques described in the incorporated '905 patent work well. Similarly, when the target FF is the same as the current FF, but the target HF is different than the current HF, only the high fraction is ramped.

In some embodiments, when a target FF and the current FF are within a specified (small) tolerance, the high fraction is ramped first. When the transition to the desired high fraction is completed, the firing fraction is changed to the target FF—often in a single step although that is not a requirement. Similarly, when the current HF is within a specified tolerance of the target HF, the firing fraction may be ramped first.

When both the firing fraction and the high fraction are changed, an approach based on effective firing density may be used. In this approach, when a firing density change is requested, the effective firing density (eFD) is gradually changed from the current firing density to the target (requested) firing density in a step wise manner. In some implementations the commanded firing density is altered each firing opportunity or other discrete period (e.g., each engine cycle, every second firing opportunity, etc.). The size of the increments/decrements each firing opportunity may be selected based on intake manifold filling dynamics, EGR change rate, etc. This can help ensure that the actual cylinder air charges relatively closely match the target air charges. In some cases the commanded firing density is incremented (or decremented) by substantially the same amount each time it is changed (e.g., each firing opportunity) to help ensure a smooth transition. This is sometimes referred to as using a linear firing density slew rate or changing the eFD monotonically (the same amount) each firing opportunity.

There are a number of different approaches by which a linear eFD slew rate can be implemented. In some embodiments, one of the FF and the HF are slewed linearly and the other is slewed as dictated by the eFD equations to ensure that the eFD slew linearly.

In some embodiments, an added constraint is that only one of the firing fraction and high fraction is changed at a time. In some embodiments, the ramping of the firing fraction or the high fraction may be held at an intermediary holding fraction to allow the other parameter to be ramped. There may also be rules regarding which variable (firing fraction or high fraction) to ramp first in any particular scenario, and at which intermediate fractions either the firing fraction or the high fraction may be held to allow the other to progress. For example, in some implementations, the fraction (first fraction) that has further to go to reach its target may be changed first until it reaches an appropriate intermediary holding fraction that is closer to its target than the other (second) fraction is to its target. The second fraction is then gradually changed until it reaches either its target or a suitable intermediary holding fraction that is closer to its target than the fraction that the first fraction is holding on is to its target. This process can be repeated back and forth as necessary until both the firing fraction and the high fraction reach their respective targets. Typically at least one of the fractions is altered each firing opportunity to provide a continuous smooth transition.

It should be appreciated that some firing fractions such as ½, ⅓ or ⅔ tend to be smoother than others. Typically one or more of these smoother firing fractions are designated as appropriate intermediary holding firing fractions. Similarly, one or more appropriate intermediate holding high fractions may be designated as well. To visualize how a larger transition may look using the one at a time transition approach, consider a change from a state in which the firing fraction is ⅕ and the high fraction is zero, to a state in which the firing fraction is 1 and the high fraction is ⅗. That is: the current state is FF=⅕; HF=0 and the target is 1-1-=1 and HF=⅗. At the same time, assuming that the holding fractions are ⅓, ½ and ⅔ for both the firing fraction and the high fraction. Since the firing fraction initially has further to go in the example given, the transition controller would initiate transition of the firing fraction first and continue transitioning until an appropriate intermediary holding firing fraction is reached, which in this case might be ½. Throughout this period, the holding fraction is held constant at zero. Note that the firing fraction did not hold at ⅓ since the firing fraction was still further from its target (1−⅓=⅔) at that point than the holding fraction was from its target (0.6−0=0.6). Once the firing fraction reaches ½ (FF=½), it is held constant since it is now closer to its target than the high fraction. At this point, the high fraction is gradually transitioned to an appropriate intermediate holding fraction, in this case HF=⅓. When the high fraction reaches ⅓, it is closer to its target then the firing fraction. As such, the high fraction is held constant at ⅓ while the firing fraction again begins transitioning. When the firing fraction reaches its next potential intermediate holding fraction (FF=⅔), the firing fraction is still further from its target than the hold fraction, thus the transition continues until the firing fraction reaches its target of one (FF=1). At that point, the FF is held constant at one while the high fraction is increased until it reaches its target of ⅗. At this point the transition is complete.

Reductions in the eFD may be handled in a reciprocal manner There are, of course, constraints in that neither the firing fraction nor the high fraction can be greater than one, nor less than zero.

As previously mentioned, in some embodiments, the eFD is gradually changed throughout the transition by incrementing or decrementing the eFD a small amount each firing opportunity. The size of the increments/decrements each firing opportunity may be selected based on intake manifold filling dynamics. This can help ensure that the actual cylinder air charges relatively closely match the target air charges.

The appropriate slew rate for any transition can depend on a number of operating parameters including current engine speed, intake/exhaust valve timing, torque demand, starting firing density and target firing density, the mass air charge associated with high or low firings, etc. The slew rate may also depend on vehicle parameters, such as manifold size, acoustic and vibration transfer paths between NVH sources and the cabin occupants, and vehicle style, i.e. sedan, sports car, luxury car, etc. By way of example, linear slew rates on the order of 0.5-5 percent per firing opportunity work well in many applications. A linear slew rate of 2% will make a transition from an effective firing density of 0 to 1 over the course of 50 firing opportunities from the time that the transition begins, which would be just over 12½ engine cycles in a four cylinder engine. A slew rate of 1% will take twice as long to transition, while a slew rate of 4% would result in transitions that take half as long. By way of example, if a transition is being made from an effective firing density of ½ to an effective firing density fraction of 1, at a slew rate of 2% would suggest that the commanded firing density for the first firing opportunity after any imposed delay would be 52%, the commanded firing density for the second firing opportunity would be 54% and so on until the desired firing density of 1 is obtained. Of course, the slewing in other instances would vary with the slew rate, as well as initial and target firing densities.

As mentioned above, when the nature of the transition is such that the delays associated with gradually ramping the eFD are acceptable, smoother operation can be obtained by using such an arrangement. However, if the nature of a particular transition is such that a quicker response is desired, it may be desirable to bypass the slewing of one or both of the eFD variables (i.e., FF or HF). That is, utilize the "fast path" previously described to provide a quicker response. In still other embodiments, the slew rate can be changed in different circumstances as well.

High/Low Output Ratio

In some implementations the ratio of the output of a cylinder fired "Low" vs. the same cylinder firing "High" (hereinafter the "low/high output ratio") in any particular engine state will essentially be a fixed value set by engine design choices such as cam strategy. However, the low/high output ratio will vary somewhat based on engine dynamics. For example, the low/high output ratio may vary somewhat as a function of engine speed and/or load and/or various engine settings (e.g., throttle settings, cam phase when a cam phaser is available, etc.). In such circumstances, the engine controller can account for such variations when selecting and implementing the desired firing density state for a particular operating state (e.g., engine speed, load, transmission gear, etc.). It can also take this change into account while changing the FF and HF during a transition.

In other implementations it may be possible to affirmatively control the low/high output ratio at some level. When such control is possible, the desired low/high ratio for any particular operating state can be affirmatively set by the engine controller within the bounds of the high/low output ratio control If the engine speed or load changes dramatically during transition between operational firing densities, the transition (e.g., a linear transition) can further account for variations in the low/high output ratio. Such accounting can be accomplished regardless of whether the low/high output ratio changes are inherent in the engine design, are a byproduct of other engine settings, or are affirmatively controlled by the engine controller.

Special Operating Modes

When an engine has the hardware necessary to support multi-level skip fire engine operation, there are several ways that such hardware can be used advantageously in specific operating conditions. For example, when a quick reduction of commanded power occurs while operating the engine in a mode in which the high fraction is greater than zero, torque can quickly be reduce when necessary by immediately changing the high fraction to zero or to an intermediate value if/when appropriate. In the embodiment of FIG. 1, this can be accomplished by using the "fast path" for the HF change. This reduction can supplement, or be supplemented by, changing the firing fraction and/or by conventional torque reduction techniques such as spark retard as appropriate. Conversely, when the engine is operating at a high fraction of less than 1, torque can be almost immediately increased by increasing the high fraction to 1 or an appropriate intermediate value. Regardless of the approach taken, the transition adjustment unit 40 can readily be programmed to implement such logic.

An advantage of changing the high fraction is that it often can be implemented almost immediately and it doesn't have the fuel efficiency penalties associated with some conventional rapid torque reduction techniques such as spark retard. The ability to be implemented almost immediately is a noteworthy advantage over techniques that rely on changes in intake manifold pressure which tend to have significant latency. It should be apparent that amount of torque that can be quickly reduced or added based on changing the high fraction alone is limited somewhat based on the current operating high fraction. It should be apparent that further reductions or increases can be made by immediately changing the firing fraction in parallel with changing the firing fraction. Thus high fraction changes and firing fraction changes provide two distinct mechanisms that can be used to quickly change the operational torque delivered by an engine.

There are a number of circumstances in which rapid, transitory changes in the output of an engine are desired. One particularly useful application is during transmission shift events. As will be appreciated by those familiar with the art, many engine controllers are designed to significantly reduce the commanded engine torque in response to a gear shift request. The gear shift is then implemented while the commanded torque is low. Once the shift is completed, the commanded torque is restored to the desired level (which may be the torque requested by a driver, an autonomous vehicle or cruise controller, etc.). Other representative applications that require rapid transitory changes in the engine output include: traction control events (e.g., loss of traction events), stability control events, wheel hop prevention events, etc. Applicant's U.S. Pat. No. 9,120,478 (which is incorporated herein by reference) describes the use of skip fire techniques to rapidly meet requests for transitory changes in the output of an engine. When multi-level firings are supported, changing the high fraction provides a very useful additional or alternative tool for rapidly delivering transitory torque modifications. This includes transmission shift events, traction control events and other transitory events.

In some specific embodiments, the engine controller immediately directs that all firings be "low" firings as part of a torque reduction in response to a gear shift command In the context of the engine controller shown in FIG. 1, the "fast path" is used so that a HF of "0" is immediately passed to firing timing determining unit 50. When a smaller cut is required, the HF may be immediately reduced to a lower fraction via the fast path. In still other circumstance, the firing fraction may be reduced in addition to the reducing the high fraction. In some circumstance, the HF and FF are immediately and simultaneously reduced (e.g., using the fast path approach). In other circumstances, the HF may be immediately reduced and the FF reduction may be slewed as described above at either a standard, or accelerated rate.

One application where it can be desirable to quickly implement an effective firing density reduction is in response to a gear shift command. In such circumstances the HF can be immediately reduced to zero and the FF set to a level desired for shifting. In the embodiment of FIG. 1, this can be quickly implemented by the firing density determining unit 30 through the selection of a particular, predefined, firing density state for use during the gear shift. The HF (e.g., "0") and the FF associated with the selected gear shift firing density state are immediately passed to firing timing determining unit 50 via the fast path. In some embodiments, the selected gear shift firing density state may vary based on one or more engine parameters such as engine speed. Again, such an approach can be implemented through the use of lookup tables using engine speed as an index or in other suitable manners. Once the gear shift is completed, the engine controller restores power by transitioning to a firing density sequence that is suitable for delivering the requested engine output in the new gear. As part of the restoration, the desired high fraction can be restored to help quickly increase the engine output to the desired torque. Depending of design preferences, the restoration of power can be immediate (e.g., via the fast path) or gradual. The appropriate transition logic for implementing the transitions associated with a gear shift may be managed by the transition adjustment unit 40.

As will be appreciated by those familiar with the art, there are a variety of other circumstances in which immediate torque reductions and/or applications may be desired and firing density management may be used to quickly respond to torque request changes at least in part by immediately changing the operational high fraction alone or in combination with immediate changes in the operational firing fraction.

Another special case where multi-level firings can be useful is transitioning out of a cylinder cut-off operating state. Skip fire engine control preferably provides the ability to deactivate individual cylinders during skipped working cycles so that air is not pumped through the cylinder. Cylinder deactivation is desirable for both reducing pumping losses and emission control purposes. The ability to deactivate cylinders provides the ability to transition the engine to a cylinder cut-off mode in which all of the engine's cylinders are deactivated at the same time. Such a mode is sometimes referred to as a Deceleration Cylinder Cut-Off (DCCO) mode because the engine usually decelerates when the cylinder cut-off mode is entered. When no torque is required by the engine, it can be desirable to enter the DCCO mode in order to minimize losses. By way of example, various DCCO control strategies are described in Applicant's Pat. Nos. 9,790,867 and 10,408,140, which are incorporated herein by reference.

When an engine has a throttle, the intake manifold pressure will generally equalize at atmospheric pressure. This can lead to undesirable NVH when firings resume—especially when the transition is to idle or other low torque outputs. In some circumstances it is desirable to pump down the intake manifold before initiating firings by activating the intake and exhaust valves appropriately to pump air through the engine. Pumping air through the engine can reduce the intake manifold pressure which allows a smaller air charge to be introduced to the cylinders when firings begin—which in turn helps mitigate NVH concern.

When multi-level firings are supported, exits from DCCO mode may be made to a firing sequence that only utilizes low firings—which could be a low fire and skip mode, or an all-cylinder load mode depending on the circumstances. Such an approach can minimize or even eliminate the need to pump down the intake manifold in conjunction with exiting the DCCO mode. This approach is described in the incorporated '964 patent.

The ability to induct different level air charges on a firing opportunity by firing opportunity basis provides a tool that can be used in a variety of other ways as well. For example, when exiting DCCO (or in other circumstances where it is desirable to pump down the intake manifold) the "High" air charge can be used in skipped working cycles to help pump down the manifold more quickly while the "Low" air charge can be used in fired working cycles to help mitigate NVH issues.

Although only a few embodiments of the invention have been described in detail, it should be appreciated that the invention may be implemented in many other forms without departing from the spirit or scope of the invention. In the various illustrated embodiments, a number of the components are diagrammatically illustrated as independent functional blocks. Although independent components may be used for each functional block in actual implementations, it should be appreciated that the functionality of the various blocks may readily be integrated together in any number of combinations. The functionality of the various functional blocks may be accomplished algorithmically as programmed instructions executing on a processor, in analog or digital logic, using lookup tables or in any other suitable manner Therefore, the present embodiments should be considered illustrative and not restrictive and the invention is not to be limited to the details given herein, but may be modified within the scope and equivalents of the appended claims.

What is claimed is:

1. A method of controlling an output of an engine having a plurality of cylinders, the engine being configured to at least sometimes operate in a cylinder output level modulation mode in which at least some of the cylinders are configured to selectively be skipped, fired at a high output level or fired at a low output level during selected associated working cycles, wherein a current operational firing density of the engine can be defined by a firing fraction indicative of a fraction of individual cylinder working cycles that are fired and a high/low fraction indicative of a fraction of the fired working cycles that are fired at the high output level, wherein for a selected firing density that has more than one possible high/low/skip sequence, there is an associated desired high/low/skip sequence the method comprising:

when the engine enters an operational state having the selected firing density, setting a parameter so that the desired high/low/skip sequence is generated, wherein an engine controller is not constrained to always cause the engine to enter the selected firing density at a pre-defined phase of the associated operational firing fraction.

2. A method as recited in claim 1 wherein a first accumulator is used to determine when firings are appropriate and when skips are appropriate and a second accumulator is used to determine when high firings are appropriate and when low firings are appropriate.

3. A method as recited in claim 2 wherein when the engine enters the operational state having the selected firing density, the second accumulator is set to a designated second value that is based on a first value held in the first accumulator.

4. A method as recited in claim 3 wherein the first and second accumulators are both first order sigma delta converters.

5. A method as recited in claim 1 wherein a lookup table is used to determine an operational phase of a high/low pattern associated with the selected firing density based on a current operational phase of a firing pattern associated with the selected firing density.

6. A method as recited in claim 1 wherein the engine has a plurality of available firing densities that each have a firing fraction and high/low fraction combination that has more than one possible high/low/skip sequence including an associated preferred high/low/skip sequence, the method further comprising:

each time the engine begins using one of the firing densities that have more than one possible high/low/skip sequence, setting an operational phase of an associated operational high/low pattern relative to an operational phase of an associated firing sequence to cause the engine to utilize the desired high/low/skip sequence associated with such firing density.

7. An engine controller configured to direct operation of an engine in a cylinder output level modulation mode in which at least some cylinders of the engine are selectively skipped, fired at a high output level or fired at a low output level during selected associated working cycles, wherein a current operational firing density of the engine can be defined by a firing fraction indicative of a fraction of individual cylinder working cycles that are fired and a high/low fraction indicative of a fraction of the fired working cycles that are fired at the high output level, wherein the engine controller is configured to direct operation at any of a set of pre-defined available firing densities in which at least some of the available firing densities have more than one possible high/low/skip sequence including an associated preferred high/low/skip sequence, the engine controller being further configured to:

direct a firing density transition to a selected one of the available firing densities having more than one possible high/low/skip sequence, wherein the selected firing density is entered at a phase of an associated firing sequence that is not pre-defined;

set an operational phase of a high/low pattern based at least in part on the phase of the firing sequence that the firing density is entered at to thereby cause the engine to utilize the preferred high/low/skip sequence for the selected firing density.

8. An engine controller as recited in claim 7 wherein a first accumulator is used to determine when firings are appropriate and when skips are appropriate and a second accumulator is used to determine when high firings are appropriate and when low firings are appropriate.

9. An engine controller as recited in claim 8 configured to set second accumulator is reset to a designated second value that is based on a first value held in the first accumulator when the engine enters the selected firing density.

10. An engine controller as recited in claim 9 wherein the first and second accumulators are both first order sigma delta converters.

11. An engine controller as recited in claim 9 further comprising a lookup table that the engine controller uses to determine the second value based on the first value.

12. An engine controller suitable for directing cylinder output modulation operation of an engine having a plurality of cylinders, the engine controller comprising:

a firing density determining module configured to determine a desired operational firing fraction and a desired operational high/low fraction;

a firing determining unit arranged to determine which cylinder working cycles to skip, which cylinder working cycles to fire high, and which cylinder working cycles to fire low during operation of the engine during cylinder output modulation operation of the engine; and a transition management unit configured to manage transitions between operating states having different firing fractions and different high/low fractions, the transmission management unit being arranged to manage a transition from a first operational state having a first firing fraction and a first high/low fraction to a second operational state having a second firing fraction and a second high/low fraction by, (a) gradually ramping an operational firing fraction from the first firing fraction to the second firing fraction over a plurality of firing opportunities; and (b) gradually ramping an operational high/low fraction from the first high/low fraction to the second high/low fraction over a plurality of firing opportunities.

13. An engine controller as recited in claim 12 wherein the first operational state has a first effective firing density and the second operational state has a second effective firing density that is different than the first effective firing density, the engine controller being further configured to always ramp the engine's effective firing density in the same direction as the transition is made from the first operational state to the second operational state.

14. An engine controller as recited in claim 12 wherein an operational effective firing density is increased or decreased by a substantially constant amount each firing opportunity during a majority of the transition from the first operational state to the second operational state.

15. An engine controller as recited in claim 12 wherein only one of the operational firing fraction and the operational high/low fraction are ramped at a time during a majority of the transition from the first operational state to the second operational state.

16. An engine controller as recited in claim 15 wherein:

the ramping of a first one of the operational firing fraction and the operational high/low fraction is accomplished in two or more ramping segments and is paused between the ramping segments; and a second one of the operational firing fraction and the operational high/low fraction is ramped during each pause in the ramping segments.

17. An engine controller as recited in claim 16 wherein the ramping of the first one of the operational firing fraction and the operational high/low fraction is only paused at one or more predetermined intermediate holding fraction(s).

18. A method as recited in claim 17 wherein the predetermined intermediate holding firing fraction(s) is/are selected from the group consisting of ½, ⅓ and ⅔.

19. An engine controller as recited in claim 12 wherein the operational firing fraction and the operational high/low fraction are both ramped at the same time for at least a portion of the transition from the first operational state to the second operational state.

20. A method of controlling an output of an engine having a plurality of cylinders, the engine being configured to at least sometimes operate in a cylinder output level modulation mode in which at least some of the cylinders are configured to selectively be fired at a high output level or fired at a low output level during selected associated working cycles, wherein a current operational state of the engine can be defined by a firing fraction indicative of a fraction of individual cylinder working cycles that are fired and a high/low fraction indicative of a fraction of the fired working cycles that are fired at the high output level at the current operational state, the method comprising:

while operating in a first operational state having a high/low fraction of greater than zero, receiving a command to reduce torque; and immediately reducing the operational high/low fraction in response to the command to reduce torque.

21. A method as recited in claim 20 wherein the operational high/low fraction is immediately reduced to zero in response to the command to reduce torque.

22. A method as recited in claim 20 wherein the command to reduce torque is responsive to a gear shift command.

23. A method as recited in claim 20 wherein the command to reduce torque is responsive to a traction control event.

24. A method as recited in claim 20 wherein the first operational state has an associated first firing fraction, the method further comprising reducing the firing fraction in response to the command to reduce torque, wherein the firing fraction reduction occurs simultaneously with or after the reduction of the operational high/low fraction.

* * * * *